US010451311B2

(12) United States Patent
Iwata

(10) Patent No.: US 10,451,311 B2
(45) Date of Patent: Oct. 22, 2019

(54) GAS HEATING DEVICE

(71) Applicant: Acos Macom Industria E Comercio Ltda., Guarulhos-Sp (BR)

(72) Inventor: Eduardo Kunioki Iwata, Sorocaba-Sp (BR)

(73) Assignee: AÇOS MACOM INDUSTRIA E COMÉRCIO LTDA, Guarulhos, Sao Paulo (BR)

( * ) Notice: Subject to any disclaimer, the term of this patent is extended or adjusted under 35 U.S.C. 154(b) by 0 days.

(21) Appl. No.: 15/014,419

(22) Filed: Feb. 3, 2016

(65) Prior Publication Data

US 2016/0273799 A1 Sep. 22, 2016

(30) Foreign Application Priority Data

Mar. 19, 2015 (BR) ..... BR2020150061400

(51) Int. Cl.
*F24H 1/20* (2006.01)

(52) U.S. Cl.
CPC ..... *F24H 1/205* (2013.01)

(58) Field of Classification Search
CPC ..... F24H 1/205; F24H 1/206; F24H 1/0054; F24H 1/12; F24H 1/20; F24H 9/0026; F24H 1/145; F24H 1/34; F24D 15/02; A47J 37/1242; A47J 37/1247; A47J 37/1252; F23D 14/70; F23D 14/36; F23D 14/045; F23M 9/003; F22B 13/04
USPC ..... 165/114; 432/148, 172, 183, 185, 194, 432/212, 248; 126/21 R, 21 A
See application file for complete search history.

(56) References Cited

U.S. PATENT DOCUMENTS 1,691,607 A * 11/1928 Kerr ..... F23D 14/70 239/431
2,429,360 A * 10/1947 Kells ..... A47J 37/1247 126/391.1
3,938,948 A * 2/1976 Moore ..... A47J 37/1247 431/171
5,033,452 A * 7/1991 Carriere ..... E02F 5/30 126/271.1
5,441,405 A * 8/1995 Bedford ..... F23D 14/045 126/110 C (Continued)

FOREIGN PATENT DOCUMENTS

BR MU8901837 U2 5/2011

*Primary Examiner* — Steven S Anderson, II
(74) *Attorney, Agent, or Firm* — Dinsmore & Shohl LLP

(57) ABSTRACT

The gas heating device comprises: a heat exchange tube (20); a gas chamber (30) provided with a pressurized gas inlet (31) and with gas injection nozzles (40) turned and open to an inlet end (21) of the heat exchange tube (20). Each gas injection nozzle (40) has only one inlet (41) open to the gas chamber (30), and one outlet (42) with its axis (Y) lying on a vertical plane (P) containing the horizontal axis (X) of the heat exchange tube (20), each gas injection nozzle (40) being associated with a deflector (50) affixed to the gas inlet chamber (30) and having an inclined deflecting plate (52) sectioned by the axis (Y) of the outlet (42) of the respective gas injection nozzle (40), said deflector (50) of one gas injection nozzle (40) being disposed on a side of the vertical plane (P) opposite to the side on which is provided the deflector (50) of an adjacent gas injection nozzle (40), an outlet end (22) of the heat exchange tube (20) being partially blocked by a deflecting cover (60).

7 Claims, 8 Drawing Sheets

(56) References Cited

U.S. PATENT DOCUMENTS

| | | | | |
|---|---|---|---|---|
| 5,472,339 | A * | 12/1995 | Rakowski | F23M 9/06 126/110 R |
| 5,655,511 | A * | 8/1997 | Prabhu | F24C 15/006 126/19 R |
| 2004/0121697 | A1* | 6/2004 | Kojima | C03B 29/08 445/24 |
| 2014/0137853 | A1* | 5/2014 | Murray | F24C 15/322 126/21 A |

* cited by examiner

GAS HEATING DEVICE

CROSS-REFERENCE TO RELATED APPLICATIONS

This application claims priority of Brazilian Patent Application BR2020150061400 filed on Mar. 19, 2015.

FIELD OF THE INVENTION

The present innovation, in the nature of a utility model, refers to improvements provided in a gas heating device to be used for heating several fluids, generally liquid or viscous fluids such as, for example, fluids contained in oil and water baths.

The gas heating device of the present innovation is of the type normally used, for example, in oil baths for frying food or in water baths for heating food, although it may also be applied for heating several fluid flows.

BACKGROUND OF THE INVENTION

The current state of the art provides different gas heating devices to be used in several applications, such as those which promote heat exchange by convection, that is, those in which the gas heating device is submerged in the bath of the liquid or viscous fluid to be heated, such as the thermal baths in the equipment designed to be used for frying or heating food.

In a summarized manner, these gas heating devices comprise a gas inlet chamber provided with gas injection nozzles, which are directed so as to produce, upon gas burning, respective flows of combustion gases through the interior of the heat tubes or heat propagation tubes. The heat, generated by the burning of the gas released by the injection nozzles, passes, with reduced speed through the interior of the heat tubes, which are usually provided submerged in the bath of the fluid to be heated.

The gas heating devices of the type described above allow the fluid (liquid or viscous) to be heated, without direct contact with the gas, with the flames resulting from gas burning, and with the combustion gases. Despite presenting these positive aspects, said usual gas heating systems tend to present low efficiency, besides usually promoting unequal heating of the fluid mass to be heated.

The low heating efficiency of the fluid mass is related to different factors, among which it may be cited the gas pressure to be released by the gas injection nozzles, it being however observed that the smaller the gas pressure, the less the thermal efficiency of the system.

Another factor that may cause a low thermal efficiency is related to the unequal heating of the fluid mass, due to the behavior of the flow of the combustion gases which is passed through the heat exchange tube maintained immersed in the fluid mass to be heated.

The usual heat tubes present a geometry defined by a continuous or substantially continuous cross section, which is devoid of elements for controlling the flow of the combustion gases. Thus, the thermal energy contained in the combustion gases produced by the burning of the gas that is released, usually at high pressure, by the gas injection nozzles, tends to be transmitted to the walls of the heat exchange tube in a non-homogeneous manner, provoking an unequal heat transmission to the fluid mass to be heated, and thus impairing an homogeneous heating of the fluid mass to be obtained with an efficiently acceptable gas consumption.

Considering the above mentioned drawbacks related to the usual gas heating devices, it was proposed the gas heating device described and claimed in Brazilian patent application MU8901837-0 of the same applicant. In this previous construction, each gas heating device comprises a gas inlet chamber provided with two parallel alignments of gas injection nozzles, the axis of each one of the nozzles of one alignment being horizontally coplanar and convergent in relation to the axis of a respective nozzle of the other alignment. The injection nozzles are provided with a radial primary air inlet, whereby the combustible flow, released by the injection nozzles, becomes a mixture of air and gas to be burned in the inlet of a respective heat exchange tube, to be maintained submerged in the fluid mass to be heated, usually contained in a tank. This constructive arrangement makes the flows of the combustion gases, coming from each two opposite and horizontally coplanar injection nozzles, to be fed in a convergent manner, to an inlet end of the heat propagation tube, said flows being mixed, in a somewhat turbulent manner, with the secondary atmosphere air, being then burned and displaced through the interior of the heat exchange tube, until reaching the outlet of the latter. The release of the gas by the gas injection nozzles should be made at a high pressure in order to obtain an efficient burning.

Aiming at maintaining the flows of the combustion gases produced by each two coplanar injection nozzles, suitably distributed throughout the entire height of the heat exchange tube and longitudinally displaced in the latter at a thermally efficient speed, the heat propagation tube of said previous construction is internally divided, throughout its height, in multiple ducts, each being operatively related to a pair of coplanar gas injection nozzles and being medianly and longitudinally provided with a deflecting wall formed in alternately inclined segments and provided with slots or windows for the controlled passage of the combustion gases along the respective duct.

Although allowing a homogeneous distribution of the flow of the combustion gases, in their displacement through the heat exchange tube, and also a controlled displacement speed of the combustion gases, the solution, object of said MU8901837-0, presents an excessively complex and costly construction, requiring a gas feed at high pressure and the provision of a great number of gas injection nozzles arranged to operate in pairs and constructed with a primary air inlet, in order to allow the formation of flame, upon releasing the combustible mixture through the gas injection nozzles in the inlet region of the heat propagation tube. Further, it is required the provision of a structure of complex construction to be mounted in the interior of the heat exchange tube, in order to form the longitudinal ducts and their respective perforated deflecting walls. Without said ducts, neither the desired homogenous heat distribution throughout the whole height of the heat exchange tube, nor a thermally efficient speed of the combustion gases during the passage thereof through the ducts are obtained.

SUMMARY OF THE INVENTION

Due to the limitations and inconveniences of the solutions of the state of the art, as discussed above, it is the object of the present innovation to provide a gas heating device for heating liquid or viscous fluids, generally contained in baths, which allows, by means of a simple and relatively low cost construction, to provide a homogeneous heating of the fluid mass to be heated with improved thermal efficiency in conformity with the acceptable standards for the combustion gases, by providing a gas supply at relatively low pressures in relation to those required in the prior art.

The gas heating device of the present innovation is of the type which comprises: a heat exchange tube to be surrounded by a fluid to be heated, and having a horizontal axis and inlet and outlet ends; a gas chamber provided with a pressurized gas inlet and with gas injection nozzles, which are turned and open to the inlet end of the heat exchange tube in order to provide, upon gas burning, flows of combustion gases through the heat exchange tube.

According to the innovation, each gas injection nozzle has only one inlet, which is open to the gas chamber, and one, outlet with its axis lying on a vertical plane containing the horizontal axis of the heat exchange tube, each gas injection nozzle being associated with a deflector which comprises a support affixed to the gas inlet chamber, on one of the sides of the vertical plane, and carrying a deflecting plate which projects in an inclined and transversal way in relation to the vertical plane, so as to be sectioned by the axis of the outlet of the respective gas injection nozzle, the deflector of one gas injection nozzle being provided on a side of the vertical plane opposite to the side on which is located the deflector of an adjacent gas injection nozzle, at least the upper portion of the area of the cross section of the outlet end of the heat exchange tube being partially blocked by a deflecting cover provided with windows having increasing dimensions in the downward direction, for a controlled exhaustion of the combustion gases.

As it can be noted, one of the novel aspects presented in the gas heating device disclosed herein relates to the construction and to the provision of the gas injection nozzles, which have a much simpler construction, provided in a reduced amount, and are deprived of a radial inlet for primary air and which, together with respective deflectors, can provide a respective gas flow, without primary air, in a direction coinciding with that of the horizontal axis of the heat propagation tube, providing a suitable gas-secondary air mixture to be burned in the inlet of the heat propagation tube, dispensing the need of high pressure in the gas inlet chamber.

The other novel aspect of the present solution relates to the proposed construction of a device that controls the displacement of the combustion gases for retaining the heat in the interior of the heat propagation tube. The construction of said device is extremely simple and has low cost, allowing the homogeneous dissipation of heat inside the heat propagation tube, without requiring the provision of a complex internal deflecting structure.

BRIEF DESCRIPTION OF THE DRAWINGS

The present innovation, presented herein in the nature of utility model, will be described below with reference to the accompanying drawings, given by way of example of a possible way of carrying out the innovation, and in which.

DETAILED DESCRIPTION OF THE INVENTION

Figure 1:
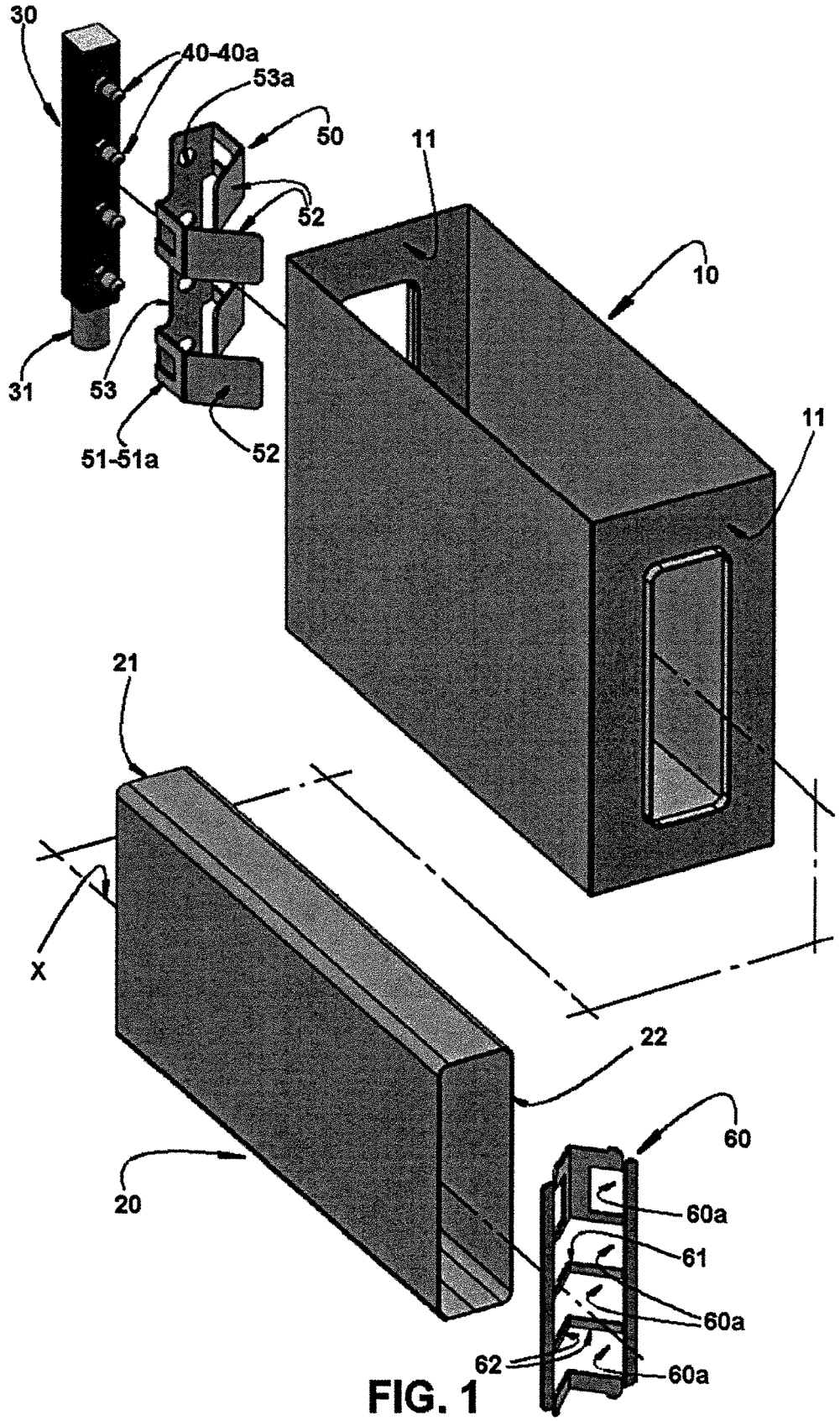
FIG. 1 shows an exploded perspective views of a gas heating device, constructed in accordance with the present innovation and to be mounted in the interior of a recipient for containing the liquid or viscous fluid to be heated.
Figure 2:
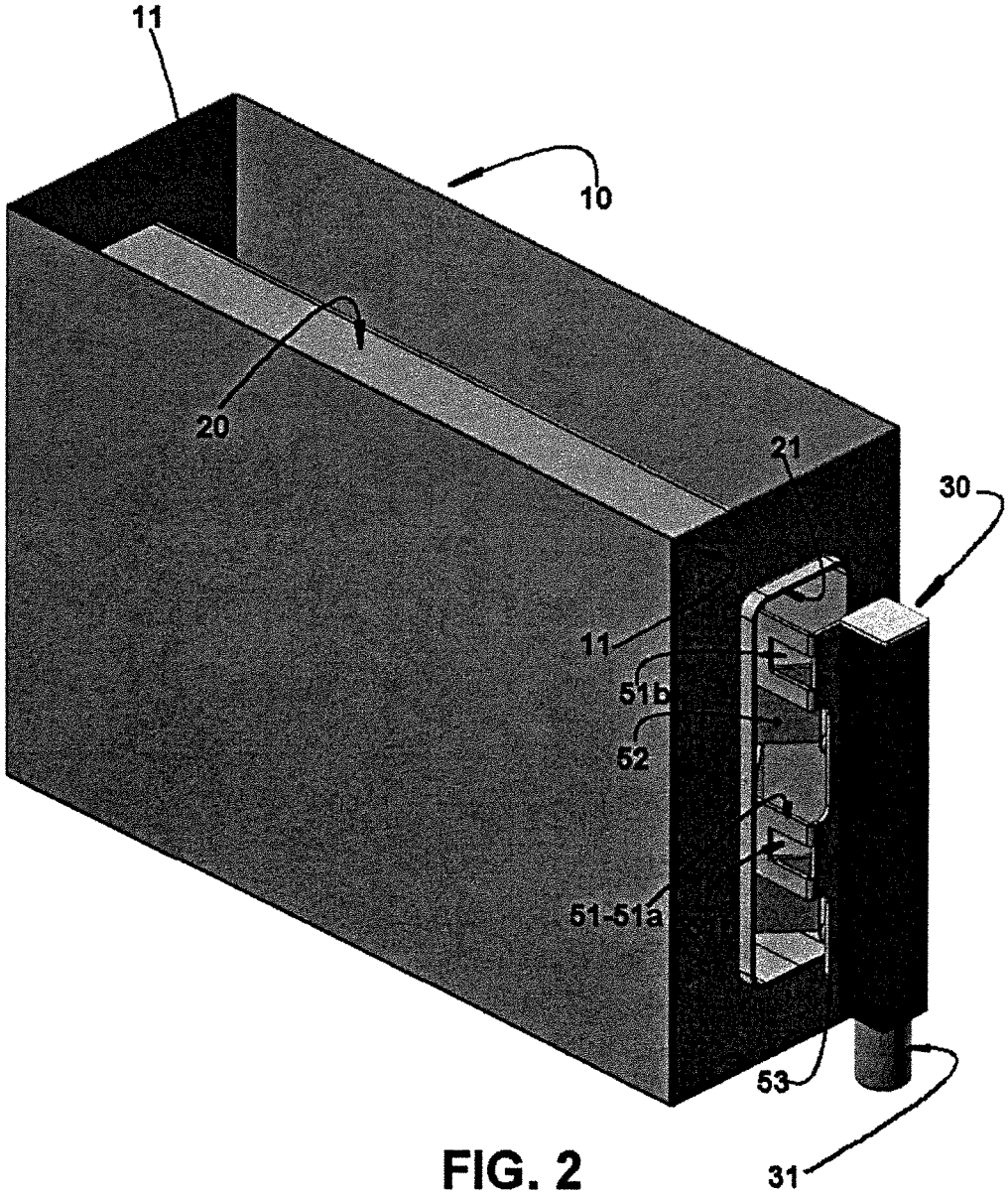
FIGS. 2 and 3 show opposite end perspective views of the assembly illustrated in FIG. 1, in a mounted condition.
Figure 3:
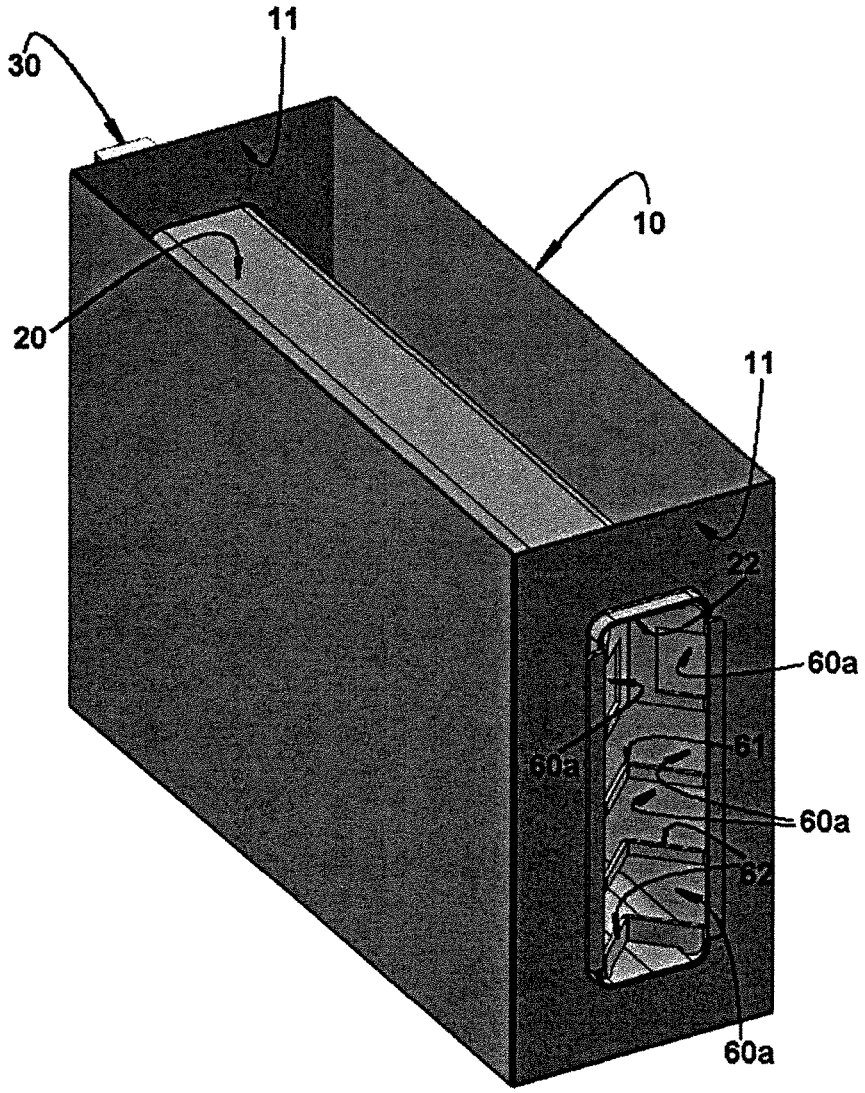
Figure 4:
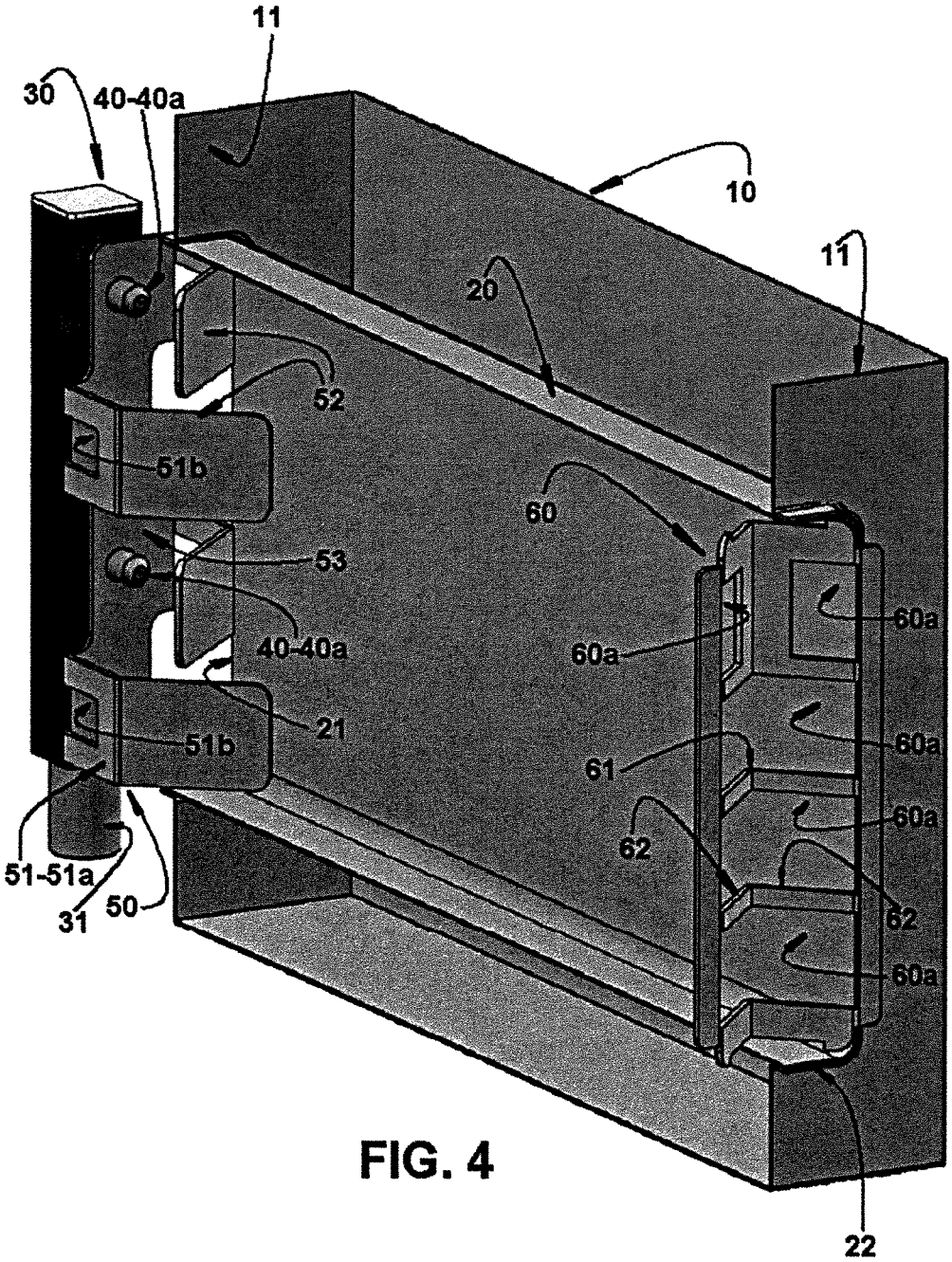
FIG. 4 shows a perspective view of the mounted assembly illustrated in FIG. 3, but longitudinally sectioned according to a vertical median plane.

As previously mentioned and illustrated in the appended drawings, the present gas heating device is of the type to be surrounded, generally by immersion, by a liquid or viscous fluid, such as water or oil, which will be heated at a determined temperature, preferably in the form of a bath contained in a recipient 10 made of stainless steel or other adequate material. In the illustrated example, the recipient has a parallelepiped shape, however it should be understood that other shapes are possible, although being less usual.

The illustrated gas heating device may be provided in a variable number, depending on the volume of the fluid contained inside the recipient 10 and to be heated at a determined temperature.

Each gas heating device comprises a heat exchange tube 20 which is also preferably of stainless steel and to be peripherally surrounded by the fluid to be heated, presenting a horizontal axis "X" (see FIGS. 1 to 7) and provided with an inlet end 21 and an outlet end 22, which are open to the atmosphere.

As illustrated in the drawings, the heat exchange tube 20 generally presents a constant cross section, having the height greater than the width. In the illustrated example, the cross section of said heat exchange tube 20 is rectangular, with its height being greater than twice its width, although it is possible to provide different cross sections compatible with the type of application and with the features of the recipient 10. The heat exchange tube 20 is dimensioned so as to be tightly fixed in the interior of the recipient 10, remaining with its inlet end 21 and outlet end 22 opened outward of the end walls 11 of the recipient 10.

Figure 10:
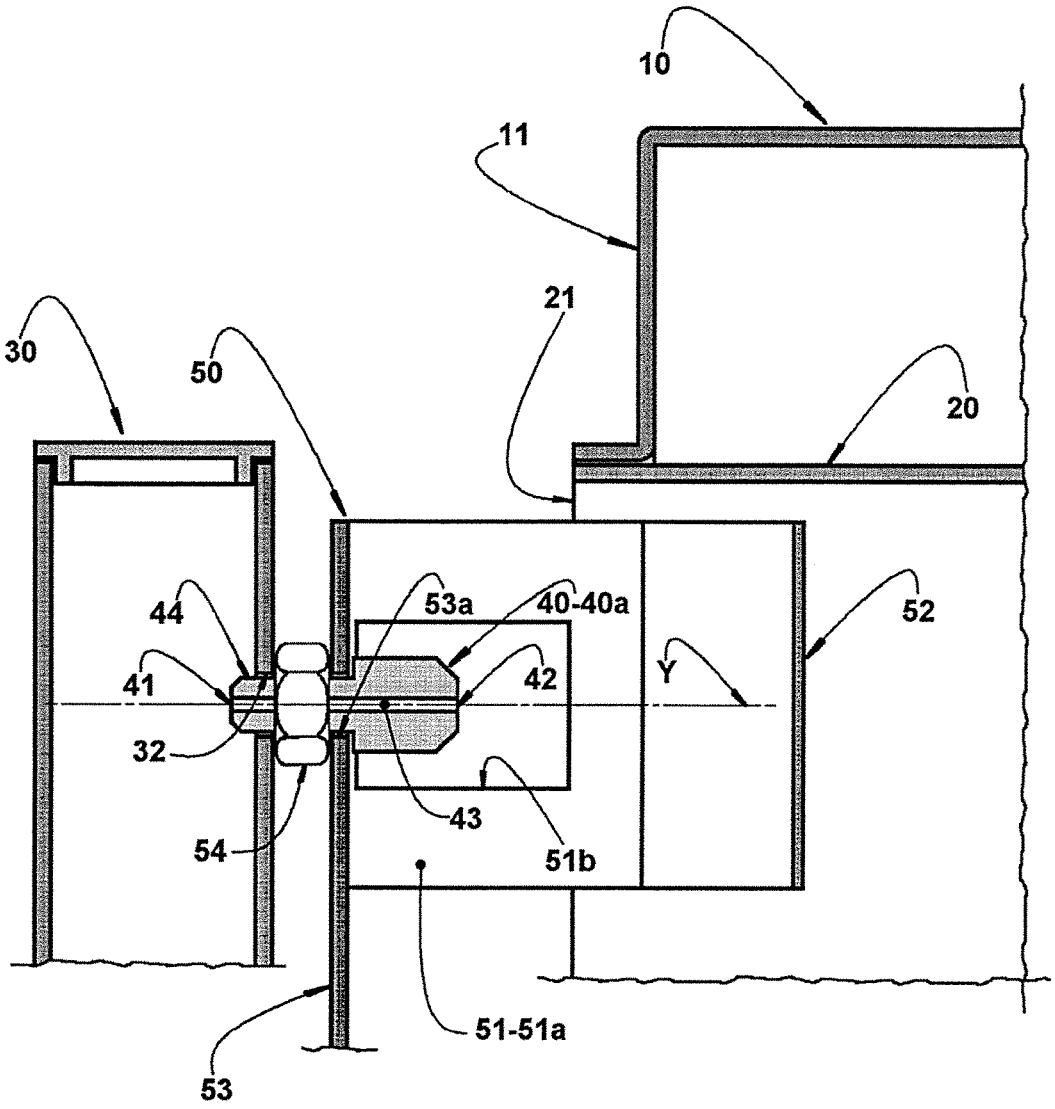
FIG. 10 shows a longitudinal cross-sectional view of a gas injection nozzle used in the present innovation.

The gas heating device further comprises a gas chamber 30 provided with a pressurized gas inlet 31, to be connected to a pressurized gas source (not illustrated), and a plurality of generally threaded orifices 32, with only one being illustrated in FIG. 10. In each orifice 32 is affixed a gas injection nozzle 40, which is open and turned to the inlet end 21 of the heat exchange tube 20, in order to provide, by the burning of the gas released by said injection nozzle 40, a respective flow of combustion gases to be displaced through the heat exchange tube 20, from the inlet end 21 and until being discharged by the outlet end 22.

The gas chamber 30 may be constructed in different materials and may present a tubular shape with different cross sections, provided that it works as a gas supply homogenizing means for all the gas injection nozzles 40, and that it presents a lateral wall extension adequate to the mounting and fixation of the gas injection nozzles 40. In the illustrated example, the gas chamber presents a tubular shape of polygonal square section.

According to the present innovation, each gas injection nozzle 40 has its body preferably formed in metallic alloy and provided with only one inlet 41, open to the gas chamber 30, and one outlet 42 which communicates with the inlet 41 by means of an internal channel 43 and which has its axis "Y" (see FIGS. 7 and 10) located in a vertical plane "P" (see FIG. 7) containing the horizontal axis X of the heat exchange tube 20. The outlet 42 of each injection nozzle 40 is restrictively calibrated for the controlled passage of the gas flow (without primary air) which reaches the gas chamber 30 at a certain pressure.

Figure 5:
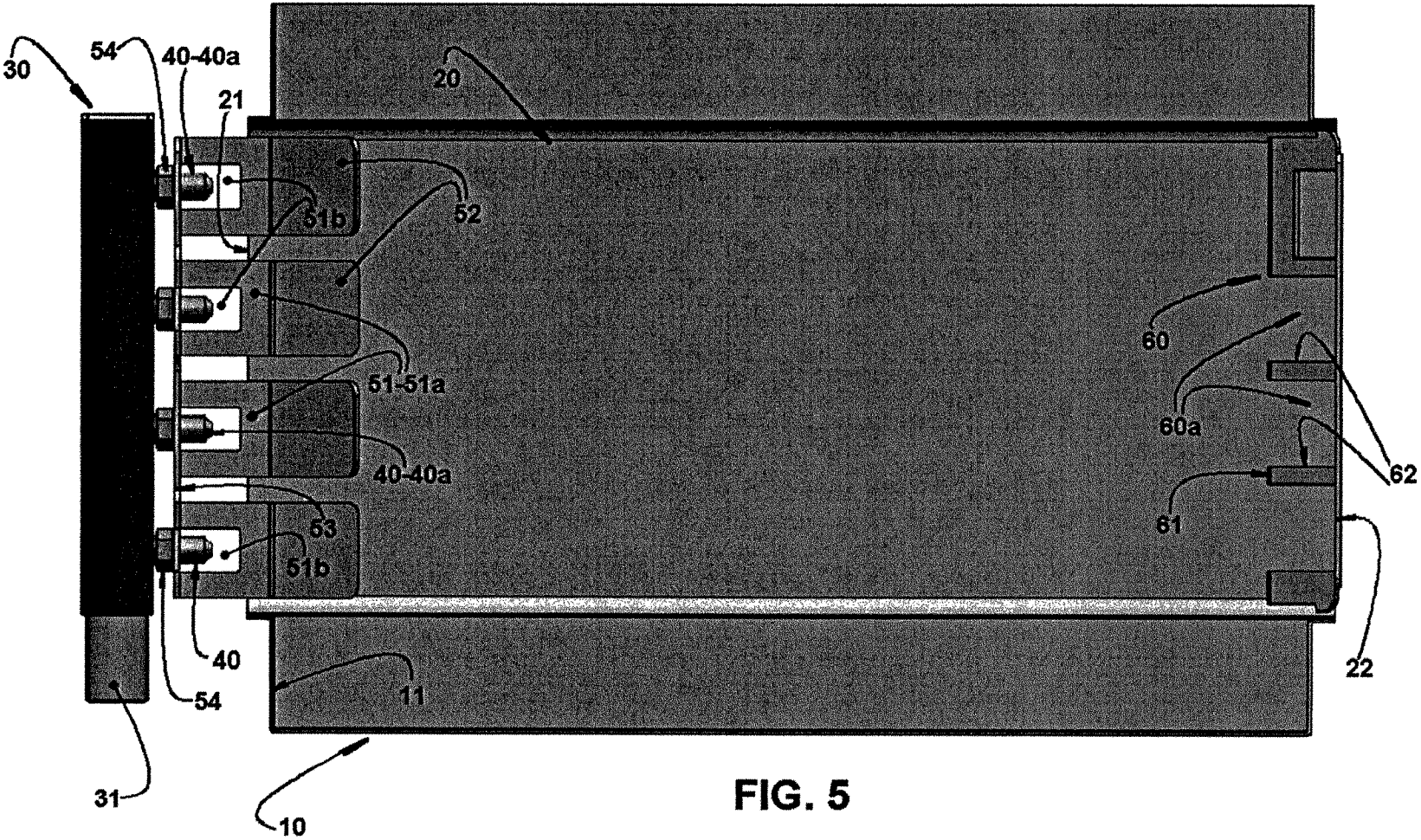
FIG. 5 shows a front view of the sectioned assembly as illustrated in FIG. 4.
Figure 6:
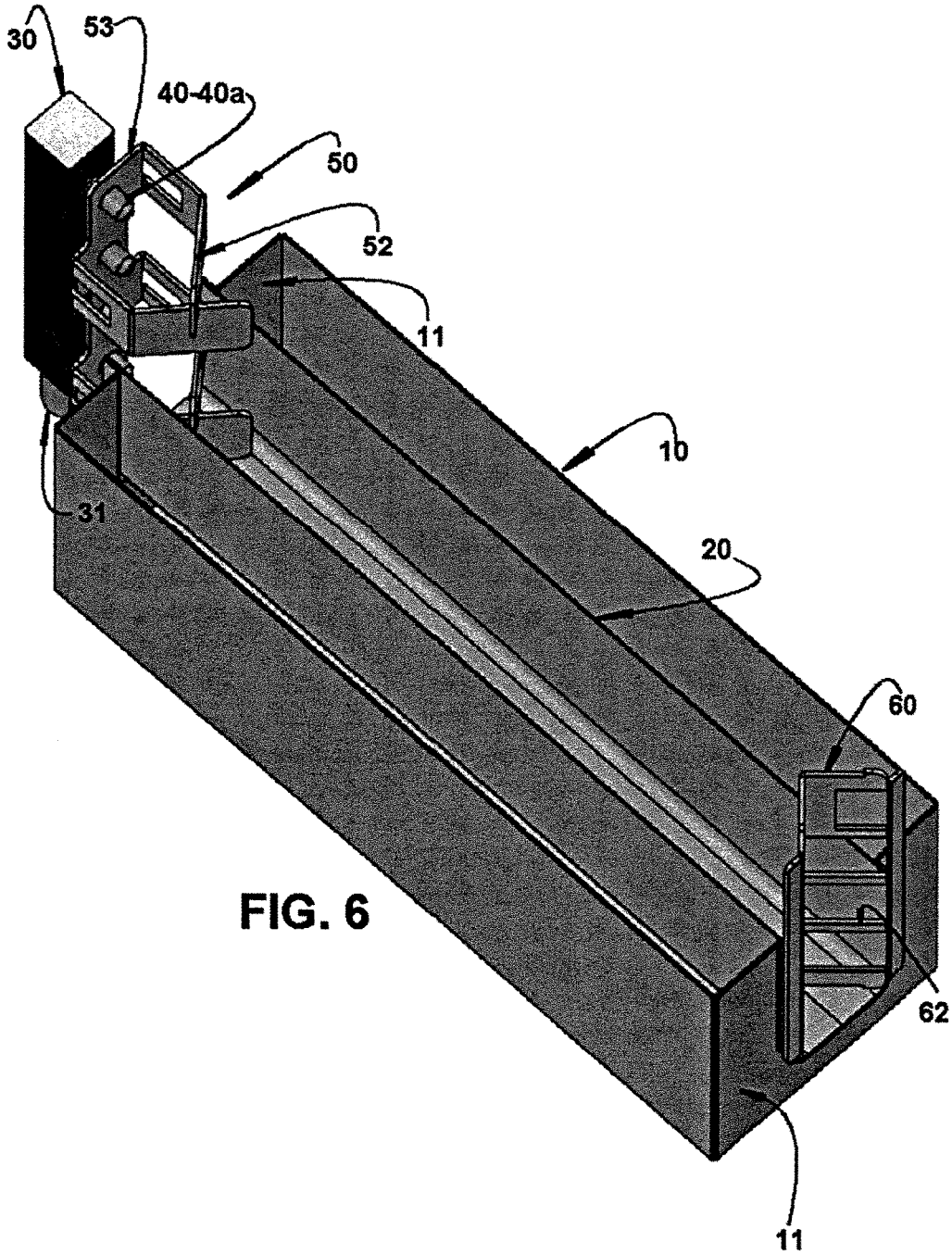
FIG. 6 shows a perspective view of the mounted assembly illustrated in FIG. 3, but with both the fluid containing recipient and the heat exchange tube being sectioned according to a horizontal median plane.

As better illustrated in FIGS. 5 and 10, each gas injection nozzle 40 has an end portion adjacent to the inlet 41 and provided with an external thread 44 to be affixed into a respective orifice 32 of the gas chamber 30, for allowing the fixation of the gas injection nozzle 40. The external thread 44 extends outwardly from the gas chamber 30, in order to receive a nut 54 for affixing an element, as described below.

In a preferred constructive form illustrated in the drawings, the outlets 42 of the gas injection nozzles 40 have their axes "Y" parallel and spaced from each other, along the height of the cross section of the heat exchange tube 20, allowing for the formation of respective flows of combustion gases throughout the entire height of the cross section of the heat exchange tube 20.

Also in accordance with the present innovation, each gas injection nozzle 40 is operatively associated with a deflector 50 comprising a support 51, which is affixed to the gas inlet chamber 30, on one side of the vertical plane "P", and which carries a deflecting plate 52 projecting, inclinedly and transversally in relation to the vertical plane "P", in order to be sectioned by the axis "Y" of the outlet 42 of the respective gas injection nozzle 40, the deflector 50 of one injection nozzle 40 being provided on one side of the plane "P" opposite to the side in which the deflector 50 of an adjacent gas injection nozzle 40 is provided.

As better illustrated in FIGS. 4 to 7, the deflecting plates 52 are positioned in the interior of the heat exchange tube 20, close to the inlet end 21 and are maintained on vertical planes inclined in relation to the vertical plane "P" which contains the horizontal axis "X" of the heat exchange tube 20, each deflecting plate 52 extending from one side of the heat exchange tube 20 until close to the opposite side, with the adjacent deflecting plates 52 being maintained spaced from each other.

In the exemplary construction illustrated in the drawings, the support 51 of each deflector 50 is defined by a shield plate 51*a*, which is located parallel to one of the sides of the vertical plane "P" and which is spaced away from the axis "Y" of the outlet 42 of the respective gas injection nozzle 40, and having a first end attached to the gas chamber 30 and a second end incorporating the deflecting plate 52. As illustrated in the drawings, in order to facilitate air admission into the region of each deflector 50, the respective support 51, preferably in the form of a shield plate 51*a*, is provided with at least one opening 51*b*.

Figure 7:
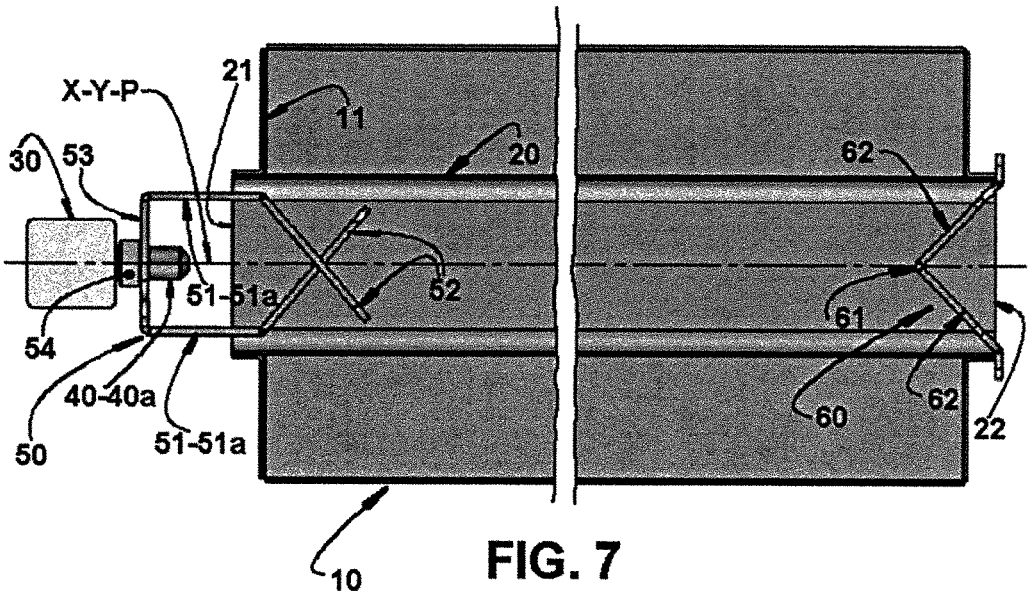
FIG. 7 shows a top plan view of the assembly sectioned as illustrated in FIG. 6.
Figure 8:
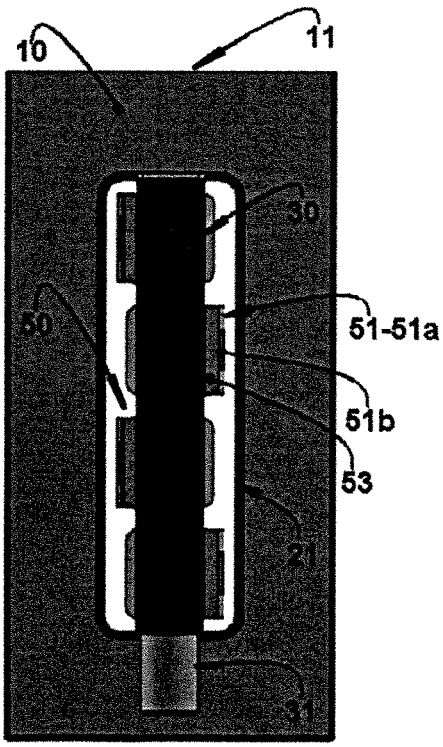
FIGS. 8 and 9 show end views of the assembly illustrated in FIGS. 2 and 3, respectively.
Figure 9:
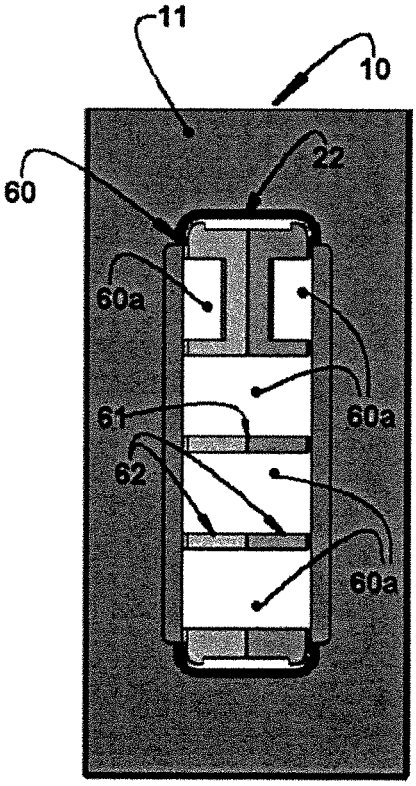

As better illustrated in FIG. 7, each shield plate 51*a* is seated against an adjacent side of the heat exchange tube 20, internally to the latter and in the region of the inlet end 21.

Preferably, the first end of the shield plate 51*a* of the deflectors 50 is incorporated, in a single piece, to a common base plate 53, which is seated and secured to the gas chamber 30 by the gas injection nozzles 40. In said construction, the common base plate 53 is provided with holes 53*a*, through which are extended the externally threaded end portions of the gas injection nozzles 40, allowing the external threads 44 thereof to receive, each one, a respective nut 54, so as to retain the common base plate 53 against a widened head 40*a* of the injection nozzle 40 (see FIG. 10).

The provision of the deflectors 50 allows the gas flow (without primary air), which is released from each of the gas injection nozzles 40, to have its speed reduced and to be mixed with the secondary air, in the region of the inlet end 21 of the heat exchange tube 20. Thus, the combustion of the gas is obtained by the pilot flame, not illustrated, which is conventionally provided in such type of gas heating device.

Aiming at improving the heat exchange efficiency and the heating uniformity, even by using a heat exchange tube 20 without internal deflecting structures, the present innovation further proposes that at least the upper portion of the cross section area of the outlet end 22 of the heat exchange tube 20 is partially blocked by a deflecting cover 60, made of a metallic material and provided with windows 60*a* having increasing dimensions in the downward direction, in order to allow for a controlled exhaustion of the combustion gases. This construction of deflecting cover 60 defines a heat retaining device in the interior of the heat exchange tube 20, improving the thermal efficiency of the gas heating device.

In the illustrated constructive form, the deflecting cover 60 has a V-shaped horizontal cross section, with its vertex 61 facing the interior of the heat exchange tube 20 and contained in the vertical plane "P", and with its lateral flaps 62 provided with the windows 60*a*, the upper windows having a free area for the passage of exhaust gas inferior to the one of the lowermost windows, allowing to avoid a great concentration of heat in the upper portion of the heat exchange tube 20, as well as a less homogeneous heating of the fluid to be heated.

From the functional point of view, it is possible to state that the gas heating device proposed by the present innovation is simple, less expensive and efficient.

The gas admitted into the gas chamber 30 through the inlet 31, flows to the gas injection nozzles 40 and is released through the outlets 42 in order to be mixed with the ambient air (single mix) and to contact the pilot flame (not illustrated). It should be pointed out that the gas, upon passing through the gas injection nozzles 40, collides with the respective deflector 50 in the interior of the inlet end 21 of the heat exchange tube 20, whereby its speed is reduced for allowing gas combustion to occur.

After colliding with the deflector 50, the gas burns and flows along the entire heat exchange tube 20. Once inside the heat exchange tube 20, the combustion product has its flowrate retention system defined by the deflecting cover 60, exchanging heat in a homogeneous way and improving the process of heat exchange between the heat exchange tube 20 and the fluid to be heated, contained in the recipient 10.

While only one preferred embodiment for the present utility model has been illustrated herein, it should be understood that changes in the form of the component parts can be made, without departing from the basic constructive and functional aspects, which characterize the new constructive solution and which are defined in the claim set which accompanies the present specification.

The invention claimed is:

1. A gas heating device comprising:

a recipient provided with end walls and having a liquid to be heated;

a heat exchange tube, mounted in the interior of the recipient, surrounded by the liquid to be heated and having a horizontal axis, and an inlet end and an outlet end each opened to the outside of the end walls of the recipient; and a gas chamber provided with a pressurized gas inlet, and with injection nozzles that are turned and open to the inlet end of the heat exchange tube to provide, upon gas burning, flows of combustion gases through the heat exchange tube, the gas chamber being characterized in that each gas injection nozzle has one inlet open to the gas chamber, and one outlet with its axis lying on a vertical plane containing the horizontal axis of the heat exchange tube, the outlets of the gas injection nozzles have their axes contained on the vertical plane, parallel and spaced from each other, through the height of the cross section of the heat exchange tube, each gas injection nozzle being associated with a deflector which comprises a support affixed to the gas chamber, on one of the sides of the vertical plane, and carrying a deflecting plate which projects, in an inclined and transversal way in relation to the vertical plane, so as to be sectioned by the axis of the outlet of the respective gas injection nozzle, the support of each deflector being defined by a shield plate located parallel to one of the sides of the vertical plane and spaced away from the axis of the outlet of the respective gas injection nozzle, and each shield plate having a first end attached to the gas chamber and a second end incorporating the deflecting plate, the deflector of one gas injection nozzle being provided on a side of the plane opposite to the side on which is provided the deflector of an adjacent gas injection nozzle, at least the upper portion of the area of the cross section of the outlet end of the heat exchange tube being partially blocked by a deflecting cover provided with windows having increasing dimensions in the downward direction, for a controlled exhaustion of the combustion gases.

2. The device, according to claim 1, characterized in that each shield plate is provided with at least one opening.

3. The device, according to claim 1, characterized in that the first end of said shield plates of the deflectors is incorporated, in a single piece, to a common base plate which is seated and secured to the gas chamber by means of the gas injection nozzles themselves.

4. The device, according to claim 1, characterized in that each shield plate is seated against an adjacent side of the heat exchange tube, internally to the latter.

5. The device, according to claim 1, characterized in that the deflecting plates are positioned in the interior of the heat exchange tube, and maintained on vertical planes inclined in relation to the vertical plane which contains the horizontal axis of the heat exchange tube, each deflecting plate extending from one side of the heat exchange tube, with the adjacent deflecting plates being maintained spaced from each other.

6. The device, according to claim 1, characterized in that the deflecting plate of each deflector is divided by the axis of the outlet of the respective gas injection nozzle.

7. The device, according to claim 1, characterized in that the deflecting cover has a V-shaped horizontal cross section, with its vertex facing the interior of the heat exchange tube and contained in the vertical plane, and with its lateral flaps provided with the windows for a controlled exhaustion of the combustion gases.

* * * * *